US006910230B1

(12) United States Patent
Schimmel

(10) Patent No.: US 6,910,230 B1
(45) Date of Patent: Jun. 28, 2005

(54) SUBMERGIBLE PUBLIC SANITARY DEVICE

(75) Inventor: Marten Alberto Schimmel, Beemte-Broekland (NL)

(73) Assignee: Urilift B.V., Beemte-Broekland (NL)

( * ) Notice: Subject to any disclaimer, the term of this patent is extended or adjusted under 35 U.S.C. 154(b) by 0 days.

(21) Appl. No.: 10/130,613

(22) PCT Filed: Nov. 16, 2000

(86) PCT No.: PCT/NL00/00839

§ 371 (c)(1),
(2), (4) Date: May 17, 2002

(87) PCT Pub. No.: WO01/36765

PCT Pub. Date: May 25, 2001

(30) Foreign Application Priority Data

Nov. 18, 1999 (NL) ..... 1013604

(51) Int. Cl.[7] ..... E03D 5/00

(52) U.S. Cl. ..... 4/300; 4/301; 4/307; 4/310; 4/311; 4/312; 4/420; 4/449; 4/461; 4/479; 4/458

(58) Field of Search ..... 4/300, 301, 307, 4/312, 310, 311, 420, 449, 461, 479, 458, 4/114.1

(56) References Cited

U.S. PATENT DOCUMENTS 580,329 A * 4/1897 Rees ..... 4/144.3
649,239 A * 5/1900 Gaalpin ..... 4/311
1,796,622 A * 3/1931 Riedinger ..... 4/252.2
2,827,004 A * 3/1958 Luce et al. ..... 109/1 S
3,601,821 A * 8/1971 Corsiglia ..... 4/300
3,760,430 A * 9/1973 Brenden ..... 4/111.1
3,829,906 A * 8/1974 McPhee ..... 4/312
4,163,294 A * 8/1979 Patterson ..... 4/449
4,174,546 A * 11/1979 Ohtake ..... 4/420
4,242,765 A * 1/1981 Russell ..... 4/321
4,305,164 A * 12/1981 Sargent et al. ..... 4/462
4,918,765 A * 4/1990 Harding ..... 4/460
5,027,446 A * 7/1991 Robertson ..... 4/254
5,095,556 A * 3/1992 Franey ..... 4/460
5,379,466 A * 1/1995 Davies ..... 4/449
5,398,352 A * 3/1995 Kordelin ..... 4/662
5,647,074 A * 7/1997 White et al. ..... 4/664
5,819,325 A * 10/1998 Richards ..... 4/237
5,898,955 A * 5/1999 Thompson ..... 4/300
5,960,483 A * 10/1999 Delzer et al. ..... 4/420
5,974,597 A * 11/1999 Conwell ..... 4/432
6,427,256 B1 * 8/2002 Mullett et al. ..... 4/476
6,496,989 B1 * 12/2002 Meiser ..... 4/420

(Continued)

FOREIGN PATENT DOCUMENTS

CH 658491 A5 * 11/1986 ..... E04H 1/12

(Continued)

*Primary Examiner*—Henry Bennett
*Assistant Examiner*—Nihir Patel
(74) *Attorney, Agent, or Firm*—Jensen & Puntigam, PS

(57) ABSTRACT

A public sanitary device, comprising one or more walk-in positions, each having a receptacle for human excrement and/or urine, which is connected to a waste pipe for connection to a sewage system. The sanitary device has the characteristic that it is provided with means for causing at least partial submerging thereof in the ground.

10 Claims, 6 Drawing Sheets

U.S. PATENT DOCUMENTS

| | | | | |
|---|---|---|---|---|
| 6,553,582 | B1 * | 4/2003 | Clark | 4/252.2 |
| 6,615,414 | B2 * | 9/2003 | Miller et al. | 4/321 |
| D483,100 | S * | 12/2003 | Krist et al. | D23/309 |
| 6,681,413 | B2 * | 1/2004 | Weiss | 4/476 |
| 6,721,967 | B2 * | 4/2004 | Braxton | 4/664 |

FOREIGN PATENT DOCUMENTS

| | | | | |
|---|---|---|---|---|
| FR | 2722221 A1 | * | 1/1996 | E03B 9/20 |
| GB | 2 205 119 | * | 11/1988 | E03D 1/00 |
| JP | 10-295584 | * | 11/1998 | A47K 11/00 |

* cited by examiner

SUBMERGIBLE PUBLIC SANITARY DEVICE

TECHNICAL FIELD

The present invention relates to a public sanitary device, comprising a housing having one or more walk-in positions, each having a receptacle for human excrement and/or urine, which is connected to a waste pipe for connection to a sewage system, and more particularly, to a submergible toilet.

BACKGROUND ART

Public sanitary provisions are known in practice; these units are usually old urinals which still exist to a limited extent, particularly in the large cities. These urinals are generally used very little because of poor hygienic conditions. Public urination is a problem which currently has to be coped with, particularly in the entertainment districts in cities, owing to a shortage of public sanitary provisions. The shortage of urinals has been partially solved heretofore by placing mobile sanitary provisions to meet the need. These units are placed on Friday evening and removed again early on Saturday morning because of shops opening. The sanitary provisions are then re-placed on Saturday evening and removed again on Sunday. This procedure is time-consuming, expensive and not very efficient.

A public sanitary device according to the preamble is also known from CH 658 491. The known sanitary device has two or more water closets and is rotatable around an axis such that one of the water closets is available for use while the other is being cleansed.

DISCLOSURE OF THE INVENTION

The invention has for its object to provide a solution herefor in the form of a sanitary device of the type stated in the preamble, characterized in that the housing is provided with means for causing at least partial submerging thereof in the ground.

The sanitary device can be submerged in the ground during the day without for instance the shopping public or market stallholders being inconvenienced thereby. In the evening it can be placed ready for use as required.

It is noted that the American patent U.S. Pat. No. 4,174,546 describes a water closet having a urine bowl that is height adjustable with respect to a support member. The known water closet does not form part of a submergible housing and is, as such, not suitable for public use.

In a first preferred embodiment the housing comprises a number of parts, which are telescopically slidable into each other, and a drive for moving the telescopically slidable housing parts. The sanitary device is telescopic in parts and takes up minimal space under the ground, so that only a relatively small construction pit need be formed.

In a compact preferred embodiment hereof the telescopically slidable housing parts comprise a first part, which is situated underground, and a second part, which is received in the first part for sliding between an underground and an aboveground position. In a more elaborate preferred embodiment the telescopically slidable housing parts comprise one or more further housing parts, which are received in the second part for sliding into each other. The sanitary device can now be extended to for instance the height of a man. In both embodiments the one or more receptacles with waste pipe are preferably arranged in the second housing part. This creates the possibility of embodying the waste pipe in an inflexible, and thus vandal-proof, material.

The embodiment in which the length of each housing part is smaller than or equal to the length of the housing part in which the relevant housing part is slidably received is very compact. In the retracted state the sanitary device can now be completely submerged in the ground.

According to a further preferred embodiment the sanitary device is provided with a roof-like element, which serves as closing element in the retracted state of the sanitary device. This closing element can for instance have the appearance and form of a manhole cover, whereby it can be integrated inconspicuously in the street scene.

The telescopically slidable housing parts preferably have a generally cylindrical form. This form is the basis for an extremely robust, and thereby vandal-proof, embodiment. The walk-in positions can be formed in efficient manner by recesses in the second and further housing parts, and substantially take the form of for instance a semicircle, in which urine basins are placed as receptacles.

In another embodiment one or more of the walk-in positions are closable. The closable walk-in positions are preferably provided with urine bowls as receptacles.

In a further embodiment the drive is hydraulic. A hydraulic drive has been found in practice to be reliable and powerful. The hydraulic drive preferably comprises a rod comprising a number of parts telescopically slidable into each other, which make it highly suitable for application in the preferred embodiment of the sanitary device with telescopically slidable housing parts. The number and length of the rod parts preferably corresponds with the number and length of the housing parts. The rod can be placed in efficient manner substantially centrally in the sanitary device.

In yet another preferred embodiment the sanitary device comprises flexible conduits for connection of the waste pipes to the sewage system. This flexibility prevents breakage or other damage to the conduits which can occur during sliding of the housing parts into each other. In a preferred embodiment the length of the second housing part is smaller than the length of the first housing part such that in the retracted state the sanitary device provides space for receiving the flexible conduits between the first and the second housing part.

According to a vandal-proof embodiment the tangible components of the sanitary device are manufactured substantially from stainless material.

The sanitary device is optionally further provided with a supply conduit for water and with means for connection thereof to a main water supply for flushing the receptacles.

The sanitary device preferably has three walk-in positions.

DETAILED DESCRIPTION OF THE INVENTION

Figure 1:
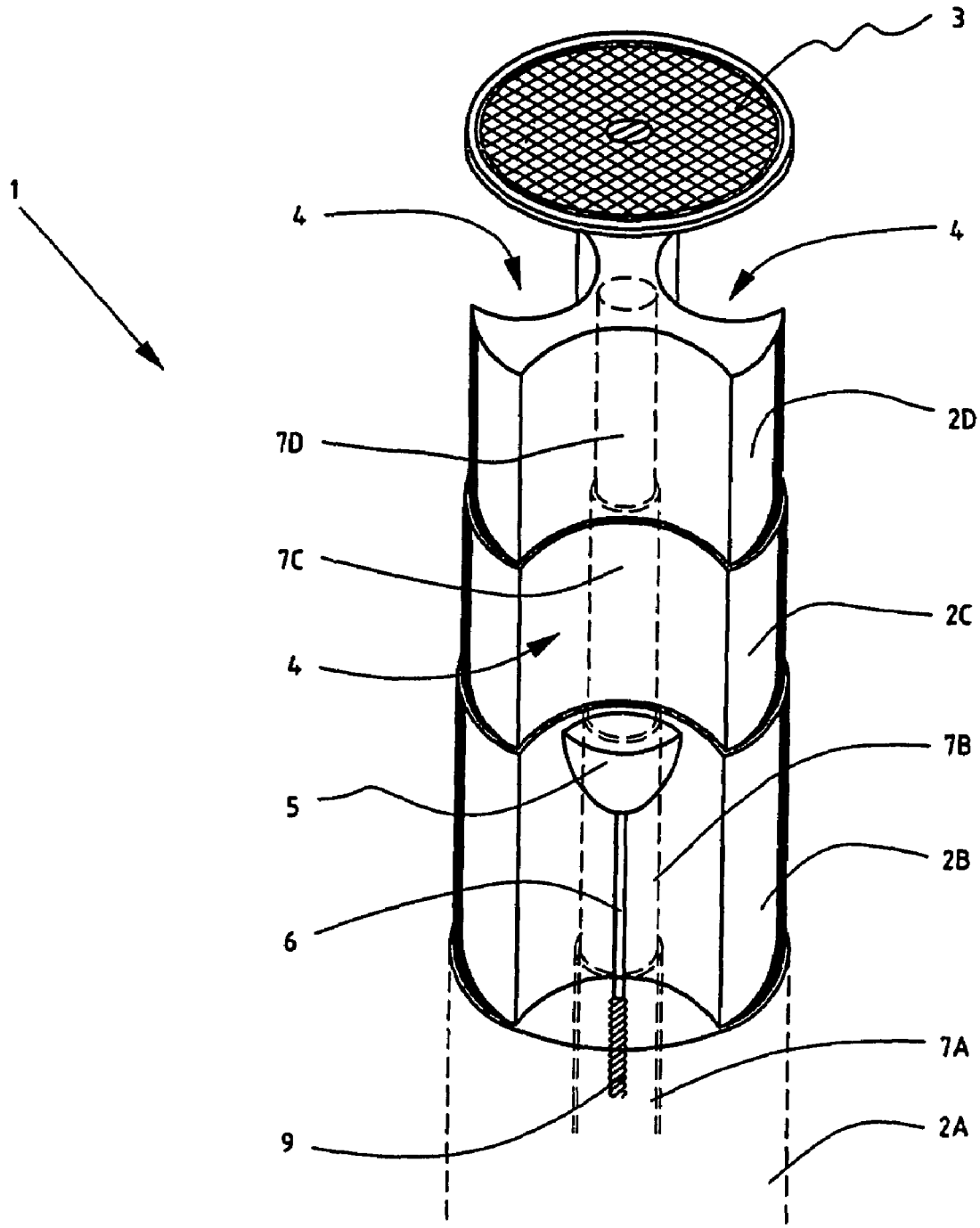
FIG. 1 shows a schematic view of a first preferred embodiment of a sanitary device according to the invention in the form of a urinal.

FIG. 1 shows a schematic view of a sanitary device according to the invention in the form of a urinal 1 in a first preferred embodiment. Urinal 1 has a housing which consists of four housing parts 2A to 2D telescopically slidable into each other, which are shown in FIG. 1 in the extended position. Housing part 2A, also referred to as the first housing part, is situated wholly underground in this embodiment, while the other housing parts are movable between an underground and above-ground position. All housing parts have a generally cylindrical form. Urinal 1 is provided with a round, preferably circular roof 3.

The above-ground housing parts 2B to 2D comprise three walk-in positions 4 which are formed by recesses in the form of a semi-circle.

Placed in each recess 4 in housing part 2B, also designated the second housing part, is a receptacle for urine or a "urine basin" 5, which can be connected to the sewer system at that location by means of a fixed waste pipe 6 and pipes 9. The cylindrical housing parts 2A to 2D are slidable into each other by means of a central hydraulically drivable rod or cylinder 7. Retracting and extending of urinal 1 will now be described in more detail with reference to FIGS. 2 and 3.

Figure 2:
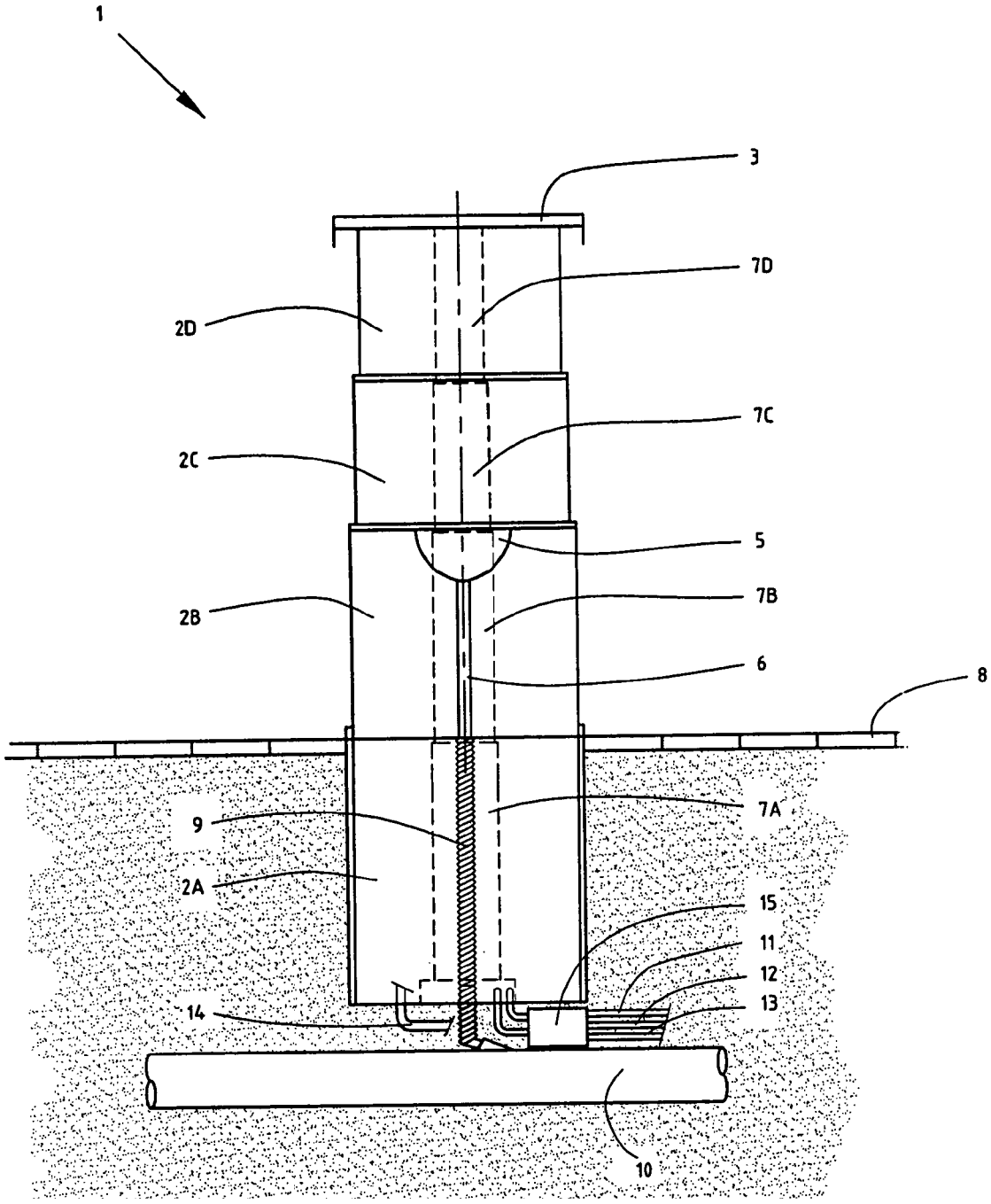
FIG. 2 shows a longitudinal section of the urinal of FIG. 1 in the extended position.
Figure 3:
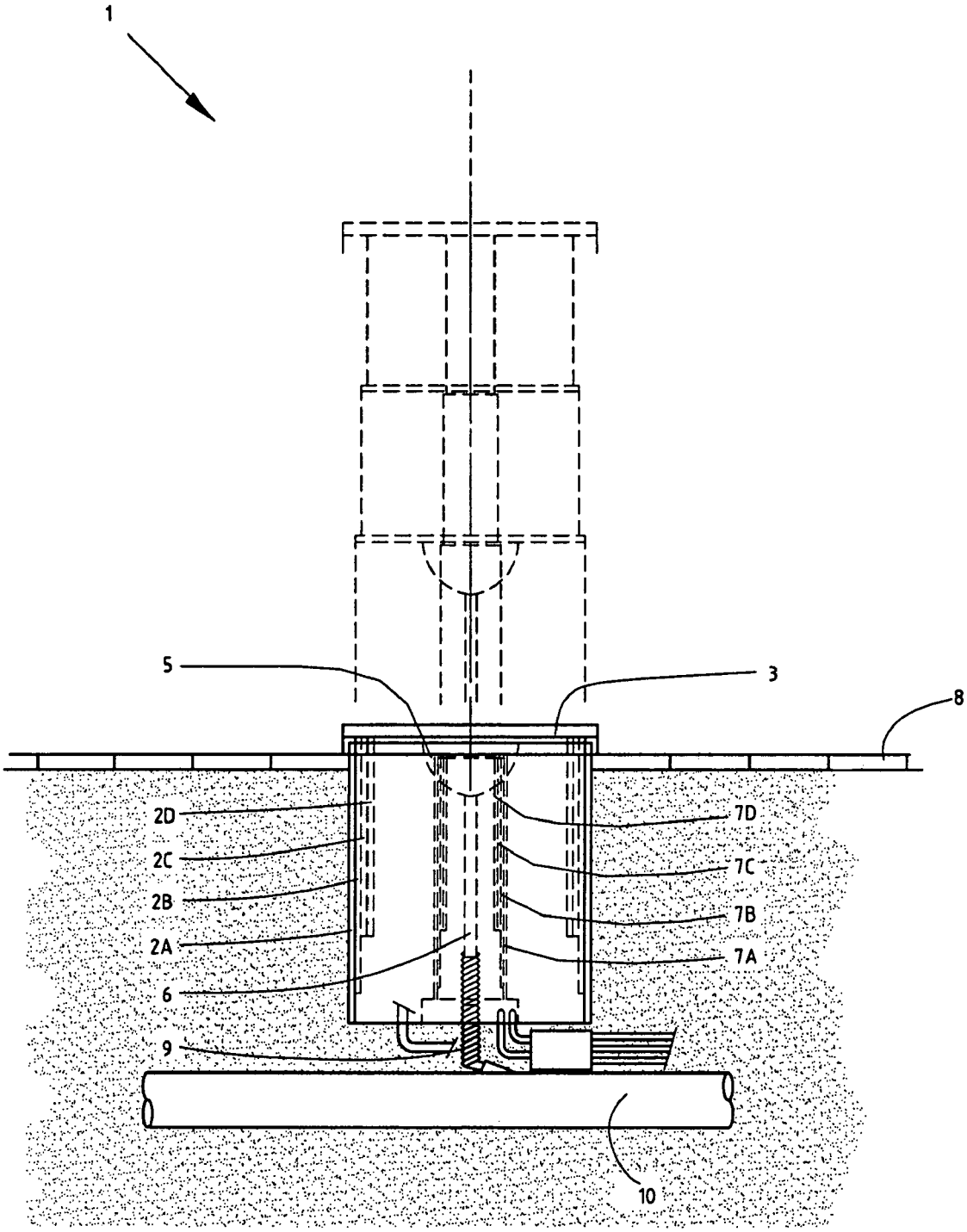
FIG. 3 shows a longitudinal section of the urinal of FIG. 1 in the retracted position.

FIG. 2 shows a longitudinal section of the urinal of FIG. 1 in the extended position, while FIG. 3 shows a longitudinal section of the urinal of FIG. 1 in the retracted position. The street level is designated 8 by way of illustration.

Rod 7 comprises a hydraulic cylinder consisting of four parts 7A to 7D, each of which substantially corresponds in length with the associated cylinder housing part, respectively 2A to 2D, which they drive. Diverse drives known in the field of hydraulics can be applied to drive hydraulic cylinder 7. In the shown preferred embodiment the drive is formed by a hydraulic pump 15 with hydraulic lines 11, 12 which can be connected to a reservoir for hydraulic fluid (not shown). If desired, the hydraulic pump can be accommodated in a separate unit (not shown) which may or may not be underground. An electricity cable 13, which can be connected to the local mains electricity, provides the required electric power.

Urinal 1 is movable between a wholly extended position (see FIG. 2) and a wholly retracted position (see FIG. 3) by means of the described hydraulic driving.

In the shown preferred embodiment the height of each housing part is less than or equal to that of the housing part in which the relevant housing part can be received. As a result hereof the urinal can be received wholly in the ground in the retracted state. In the shown preferred embodiment, housing part 2D and 2C are the same size. These are both smaller than housing part 2B, which is in turn smaller than housing part 2A. The difference in length between part 2A and part 2B is chosen such that in the retracted position of the urinal there is sufficient space for the conduits 9 connecting waste pipes 6 to sewer 10. Conduits 9 are embodied flexibly for this purpose and can for instance be stretched or rolled up.

The dimensions of rod parts 7A to 7D are chosen such that they can move the respective housing parts 2A to 2D from the wholly extended to the wholly retracted position, and vice versa.

In the retracted position the roof 3 forms the closure of urinal 1. By giving roof 3 a circular form it has the appearance of a manhole cover which can be integrated inconspicuously in the pavement.

Figure 4:
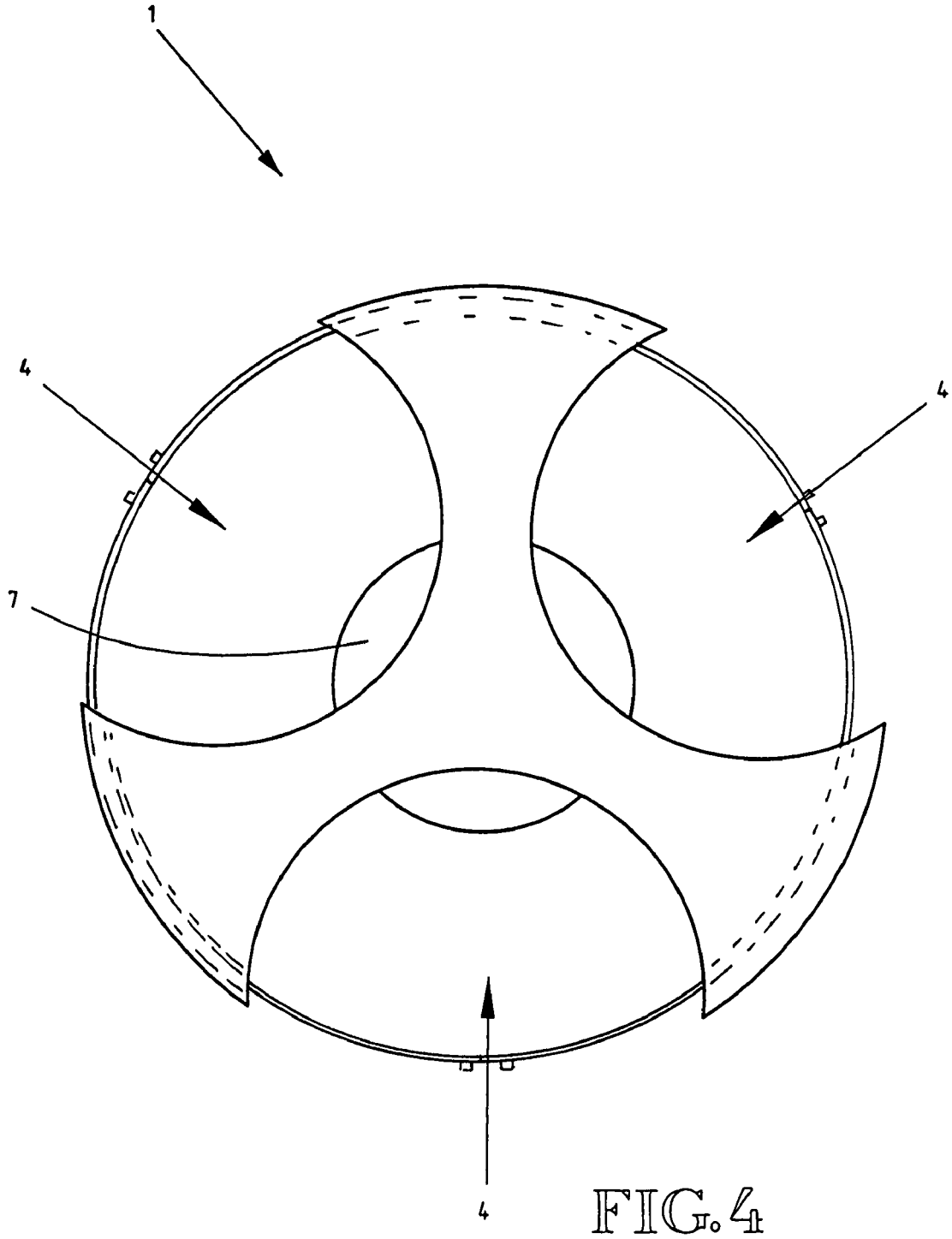
FIG. 4 shows the urinal of FIG. 1 in cross-section.

FIG. 4 shows the preferred embodiment of urinal 1 in cross-section. The choice of a cylindrical form with three recesses 4, each in the form of a semicircle, imparts a sturdy as well as elegant construction to the urinal.

Figure 5:
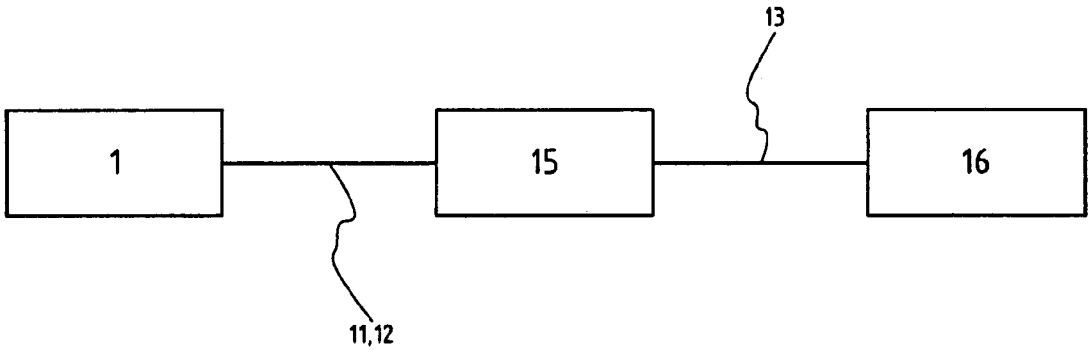
FIG. 5 shows schematically the operating components of the urinal the operating components of the urinal according to the invention.

Finally, FIG. 5 shows schematically the operating components of the urinal according to the invention. Urinal 1 is connected by means of hydraulic lines 11, 12 to hydraulic pump 15 which can be operated with an electric switch 16 by means of electric cable 13. Switch 16 is preferably situated in the vicinity of urinal 1 such that the operative has a clear overall view of the situation at the particular location, prior to retracting or extending of the urinal, so as to avoid situations occurring which are possibly hazardous for bystanders.

A water conduit 14 is optionally further provided which connects the urinal to the local mains water supply for flushing the urine basins. Flushing could for instance be carried out automatically after a determined, adjustable period of time by means of a time-controlled mechanism.

Lighting can optionally be arranged in the walk-in positions.

Figure 5A:
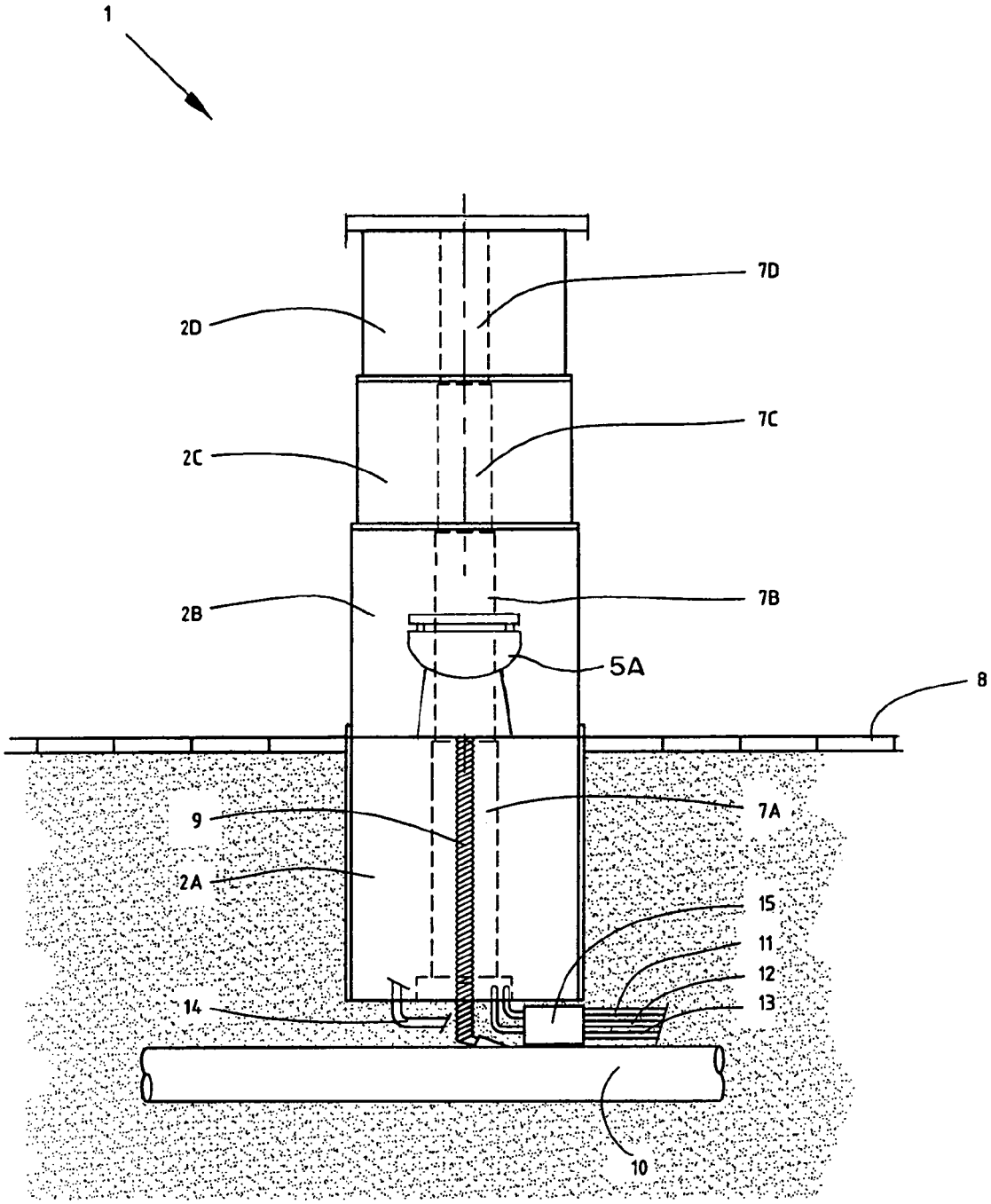

FIG. 5A is essentially identical to FIG. 3, except it depicts a different receptacle 5A.

It is noted that the invention is expressly not limited to the described and shown preferred embodiment. One for more toilet bowls can for instance be arranged in the walk-in-positions instead of one or more urine basins, wherein the walk-in positions instead of one or more urine basins, wherein the walk-in positions are then preferably closable, for instance by means of a sliding door or other suitable construction. The number of walk-in positions can be varied as desired. This is likewise the case for the shape of the urinal. It is also conceivable to choose another drive for sliding the housing parts into each other. The number of housing parts slidable into each other can likewise be varied. The urinal can for instance consist of two housing parts slidable into each other, wherein the shown preferred embodiment can be largely retained by choosing housing part 2A and housing part 2B. Alternatively, the urinal can also consist of one part, which is submergible in its entirety in the ground. All the stated examples of possible variations can be implemented by a skilled person in the field after reading of ties patent application.

The invention therefore extends generally to any embodiment which falls within the scope of the appended claims seen in the light of the foregoing description and attached drawings.

What is claimed is:

1. A public sanitary device for permanent repetitive use (1), comprising a housing (2A, 2B), having at least one walk-in position (4), each walk-in position having a receptacle (5) for human waste, which housing is provided with means for causing at least partial submerging thereof in the ground characterized in that, the housing comprises at least two telescopically interconnected housing parts adapted to be placed underground, and a drive (7, 11, 12, 15) for moving the second housing part between an underground and a substantially above-ground position, which is stable and secure and ready for use, wherein at least one receptacle (5) with a waste pipe (6) is located in the second part, for connection to a sewage system.

2. Public sanitary device as claimed in claim 1, wherein the housing parts comprise one or more further parts (2C, 2D) which are receivable in the second part (2B) and wherein the drive is arranged for telescopically sliding the housing parts into each other.

3. Public sanitary device as claimed in claim 2, wherein the length of each housing part is smaller than or equal to the length of the housing part in which the relevant housing part is slidably receivable.

4. Public sanitary device as claimed in claim 1, wherein the sanitary device is provided with a roof-like element (3), which serves as closing element in the retracted state of the sanitary device.

5. Public sanitary device as claimed in claim 1, wherein the walk-in positions are formed by recesses (4) in one or more of the telescopically slidable housing parts.

6. Public sanitary device as claimed in claim 1, wherein the drive (7, 11, 12, 15) is hydraulic.

7. Public sanitary device as claimed in claim 6 wherein the hydraulic drive (7, 11, 12, 15) comprises a rod (7) comprising a number of parts (7A, 78, 7C, 7D) telescopically slidable into each other.

8. Public sanitary device as claimed in claim 7, wherein the number and length of the rod parts (7A, 7B, 7C, 7D) corresponds with the number and length of the housing parts (2A, 2B, 2C, 2D).

9. Public sanitary device as claimed in claim 7, wherein the rod (7) is placed substantially centrally in the sanitary device.

10. Public sanitary device as claimed claim 1, wherein one or more walk-in positions are closable.

* * * * *